United States Patent [19]

Laux

[11] 4,266,350

[45] May 12, 1981

[54] FOOTWEAR INSOLE

[75] Inventor: Joseph J. Laux, Scottsdale, Ariz.

[73] Assignee: Ormid Company, Phoenix, Ariz.

[21] Appl. No.: 67,691

[22] Filed: Aug. 20, 1979

[51] Int. Cl.[3] ..... A43B 13/40; A43B 7/06

[52] U.S. Cl. ..... 36/44; 36/3 B

[58] Field of Search ..... 36/44, 43, 26, 30 R, 36/3 B

[56] References Cited

U.S. PATENT DOCUMENTS

| | | | |
|---|---|---|---|
| 621,238 | 3/1899 | Forbush | 36/44 |
| 1,342,967 | 6/1920 | McMaster | 36/44 |
| 1,867,431 | 7/1932 | Wood | 36/44 X |
| 2,027,072 | 1/1936 | Tweedie | 36/44 X |
| 2,055,574 | 9/1936 | Hartl | 36/44 |
| 2,139,260 | 12/1938 | Cuozzo | 36/44 X |
| 2,572,670 | 10/1951 | Schwartz | 36/44 X |
| 2,713,215 | 7/1955 | Cosneck | 36/44 |
| 3,071,877 | 1/1963 | Stickles | 36/44 |
| 3,448,533 | 6/1969 | Beckwith | 36/44 |

FOREIGN PATENT DOCUMENTS

| | | | |
|---|---|---|---|
| 3116 | of 1885 | United Kingdom | 36/44 |

*Primary Examiner*—James Kee Chi

*Attorney, Agent, or Firm*—Gregory J. Nelson

[57] ABSTRACT

An insole for insertion in footwear having a laminated structure. The upper layer of the laminated structure is a split suede leather and the lower layer or laminate is resilient having an outer surface with frictional characteristics to prevent slipping relative to the footwear. Resilient padding is interposed between the layers in the metatarsal area and extending rearwardly at least to an area corresponding to the area of the long medial arch.

2 Claims, 10 Drawing Figures

FOOTWEAR INSOLE

The present invention relates to a foot appliance and more particularly relates to an insole which is insertable in a shoe or other footwear to cushion shocks and relieve pressure on the foot.

The anatomical structure of the foot is in the form of a tripod, the major portion of the weight of a person, being supported at the heel and at the head of the first and fifth metatarsal bones. Forces applied at these points are substantial. As a result of the application of these rather substantial forces, discomfort can arise particularly if the footwear is not properly designed or cushioned. In some cases, improper or insufficient cushioning of the footwear can result in or can cause or aggravate foot disorders and vascular conditions.

Various devices can be found in the prior art which attempt to cushion or relieve stress imposed on the weight bearing portions of the foot. Generally these devices are orthopedic appliances to alleviate conditions such as flat-footedness or comprise simple resilient cushions insertable in footwear. Typical of devices of this type are shown in U.S. Pat. No. 1,128,220.

The prior art also shows various devices such as arch supports which are deformable and support the arch portion of the foot. These cushions generally incorporate a sponge or other elastic material in the arch portion of the support. Devices of this type are shown in U.S. Pat. Nos. 2,163,906 to Cote; 2,546,827 to Laventhall. One particular type of device which has achieved some commercial success is the type of foot cushion sold under the registered trademark "Vincent's Cushion" manufactured and distributed by the assignee of the subject application which has a resilient cushion partially covered by full grain leather.

The present invention provides a novel and unique foot cushioning device which is an insole insert for placement in footwear. The insole is a laminated structure generally conforming in shape to the footwear of the user extending from the heel portion to the metatarsal portion of the foot. The top layer or laminate immediately adjacent the plantar surface of the foot of the wearer is split leather and the bottom layer or laminate adjacent the footwear surface is a waffle sponge rubber. A cushion is provided between the layers in the metatarsal and along the area of the long medial arch. An adhesive material with a peelable cover is affixed to the bottom layer to assist in maintaining the insole in position in the shoe and to prevent it from becoming dislodged when the wearer removes the footwear.

The above and other objects and advantages of the present invention will become more readily apparent from the following description, claims and drawings in which:

Figure 1:
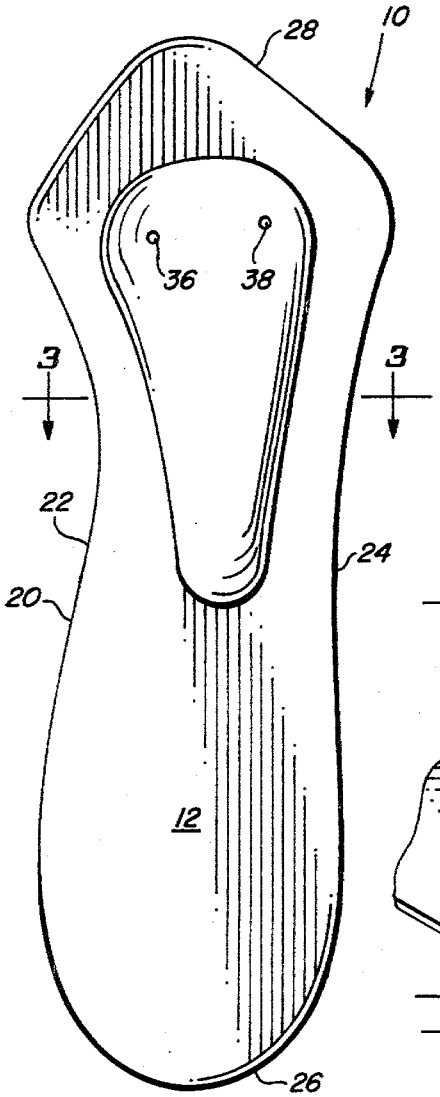
FIG. 1 is a plan view of the top surface of the preferred embodiment of the insole of the present invention.
Figure 2:
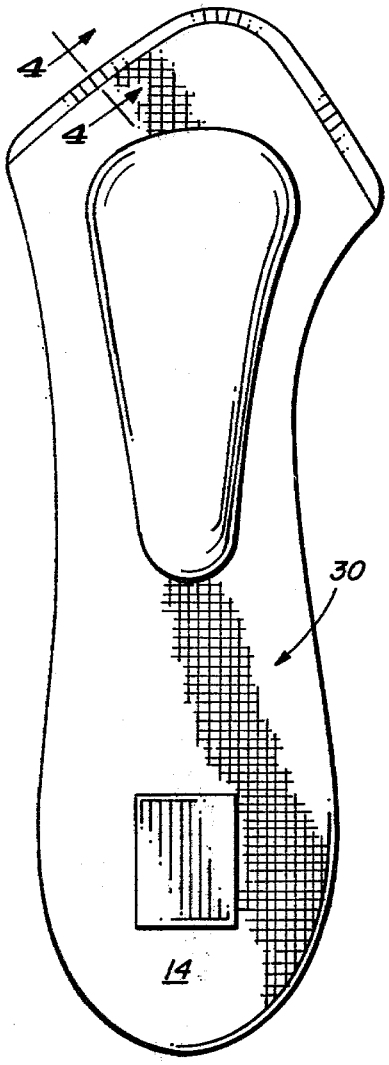
FIG. 2 is a plan view of the bottom surface of the insole of the present invention.

Turning now to the drawings, FIGS. 1 through 6, show preferred embodiments of the insole of the present invention generally designated by the numeral 10. Insole 10 is adapted for use with the right foot of the wearer. It will be apparent that the left insole will be the mirror image of that shown. The insole 10 is comprised of an upper or top laminate or layer 12 and a bottom laminate or layer 14 which, as best seen in FIGS. 1 and 2, have a configuration best adapted for sandals, clogs and open shoes. Insole 10 has a lateral side 20 having an indentation 22 along the portion corresponding to the long medial arch. An opposite lateral side 24 extends to the generally rounded heel section 26 which, when worn, is positioned generally below the os calsis portion of the foot of the wearer. The front portion of the insole 10 is configured in a generally triangular shape 28 extending from the forward part of the medial side 20 to the lateral side 24 which terminates in the metatarsal area of the foot.

Figure 3:
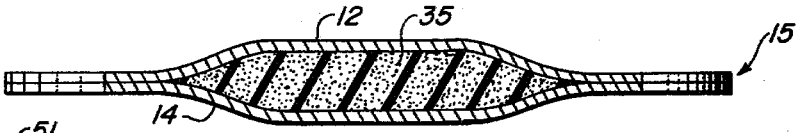
FIG. 3 is a sectional view taken through the metatarsal area of the insole along lines 3—3 of FIG. 1.

As best shown in FIG. 3, the insole 10 is a laminated structure with the outer edges of the upper or top laminate 12 and the bottom layer or laminate 14 bonded substantially over their entire inner surfaces at interface 15. The laminate 12 is a natural material such as 2½ to 3 ounce split leather. The suede split leather gives long wearing characteristics and has proper porosity so that the insole "breathes" to minimize foot perspiration. The use of suede, as contrasted to full grain leather, also minimizes slip relative to the foot of the wearer. The bottom layer or laminate 14 is a cushioned layer, preferably of sponge rubber or other resilient material. Typically a cushioned sponge rubber 1/16 inch thick is sufficient with the outer surface layer 14 provided with frictional characteristics to minimize slip in the shoes. As shown in FIGS. 2, a "waffle" imprint 30 is provided in the exterior surface of layer 14 to provide friction.

To further minimize slip when the insole 10 is inserted in the shoe, an adhesive section 32 is provided in the heel portion of the insole on the bottom layer 14. Adhesive surface 32 is covered with a peelable protective layer 34 which is removed when the insole is inserted in footwear.

As best seen in FIGS. 1, 2 and 3, additional cushioning is provided generally in the area corresponding to the transverse arch of the foot extending from generally the metatarsal area rearwardly to a terminal location in the long medial arch area. The cushion material comprises a layer of latex foam rubber, typically approximately 3/16 inch thick. Holes 36 and 38 further provide ventilation for the form cushion 35.

Figure 4:
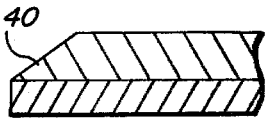
FIG. 4 is a sectional view taken along lines 4—4 of FIG. 2.
Figure 6:
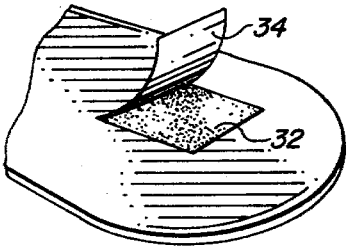
FIG. 6 is a partial perspective view of the underside of the heel portion of the insole of the present invention.

The insole of the present invention will become more clearly understood from the following description of manufacture. The upper layer 12 is stamped or die cut from leather, as for example 2½ ounce split Panama suede leather. The bottom layer 14 is similarly die cut or stamped from a sheet of cushioned sponge. The intermediate cushioning pad 35 is cut and positioned between the two layers which are bonded using a suitable adhesive such as a latex cement such as that sold under the tradename "Loc-Bond", No. 938 water base latex cement. The adhesive is applied substantially over the entire contact area 15 as seen in FIG. 3. Finishing may be completed by grinding the peripheral surfaces of the completed insole and applying a bevel at the forward edge of the upper surface as best seen in FIG. 4 and indicated by the numeral 40. The bevel 40 eliminates an abrupt edge which may be felt by the wearer. The adhesive section 32 is applied to the upper surface 12 and covered with a peelable adhesive strip 34.

In use, the insole is positioned in the shoe of the wearer after the peelable covering 34 has been removed from the adhesive section 32. Surface 14 is placed against the inner surface of the shoe. The waffle surface 30 of the resilient layer 14 provides frictional resistance to aid in minimizing slippage of the insole. The upper leather surface of the insole provides a soft cushion for the foot of the wearer further supplemented by the resiliency of lower layer 14. Support and cushioning is provided in the metatarsal area by cushion material 35. The insole is light, cushions the metatarsal area and relieves pressure along the plantar surface of the foot extending from the metarsal to the os calsis. The suede upper surface reduces slip and provides a resilient cushion providing better fit particularly with high fashion shoes.

Figure 7:
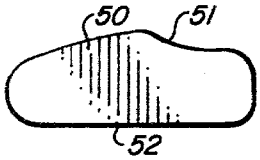
FIGS. 7, 8, 9 and 10 are plan views showing alternate shapes of the insole for use with various types of footwear.

FIGS. 7, 8, 9 and 10 show an alternate embodiment of the present invention to be used with various types of footwear. For example, FIG. 7 shows an insole generally designated by the numeral 50 which is designed for use with women's low to mid-heel shoes having a convex medial side 51 and generally straight lateral side 52.

Figure 8:
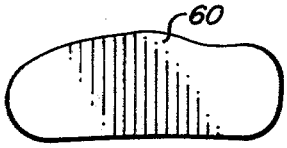
Figure 5:
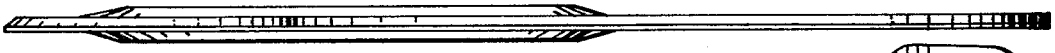
FIG. 5 is a side elevational view of the insole of the present invention.

Similarly, FIG. 8 shows an insole 60 having an outer configuration best designed for use with most men's shoes.

Figure 9:
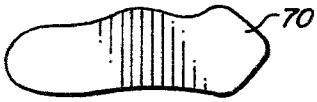

In FIG. 9, the insole is generally designated by the numeral 70 and has an exterior configuration best suited for mid to high-heel shoes.

Figure 10:
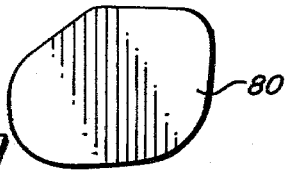

FIG. 10 shows an insole insert 80 having a configuration adapted for insertion in women's high heel shoes. The insert 80 is adapted to be placed under the metatarsal area and improve the fit and prevent slippage of one foot, particularly in high fashion shoes. In other respects, the construction of the insoles 50, 60, 70 and 80 has been described with reference to insole 10 shown in FIGS. 1 through 6. The particular peripheral configuration may vary in accordance with the design of footwear but generally have a concave or convex medial edge, a substantially straight lateral edge and front and a curved heel portion.

It will be obvious to those skilled in the art to make various changes, alterations and modifications to the insole described herein. To the extent that these various changes, alterations and modifications do not depart from the spirit and scope of the appended claims, they are intended to be encompassed therein.

I claim:

1. An insole for footwear comprising:

(a) An upper laminate of split suede leather having the entire upper surface of suitable texture to minimize slippage relative to the wearer's foot, said upper laminate having adequate porosity to "breath", allowing air to the wearer's foot;

(b) a lower laminate of resilient material having a bottom surface having suitable frictional characteristics to minimize slipping relative to footwear;

(c) said upper and lower laminate being joined over substantially the entire contact area and having an outer configuration generally conforming to footwear to be worn and having a lateral side, medial side and front and rear edges, and at least said front edge of said lower laminate being upwardly and outwardly beveled toward said upper laminate whereby the front edge of said insole does not present an obstructing edge to the wearer's foot;

(d) an adhesive area on the bottom side of said lower laminate, said adhesive area being covered by a removable covering; and (e) resilient cushioning means interposed between said upper and lower laminate generally in the area conforming to the metatarsal area of the foot, said resilient cushioning means being a resilient foam and extending rearwardly to an area intermediate to said front and rear edges, said upper laminate defining at least one aperture therethrough in the area occupied by said resilient cushioning means to further allow the insole to "breath".

2. The insole of claim 1 wherein said lower laminate is sponge rubber and said outer surface has a waffle design impressed therein.

* * * * *